US006779305B2

(12) United States Patent
Harter

(10) Patent No.: US 6,779,305 B2
(45) Date of Patent: Aug. 24, 2004

(54) DOOR VIEWER PLUG

(76) Inventor: Shan E. Harter, 982 E. Constitution, Chandler, AZ (US) 85225

( * ) Notice: Subject to any disclaimer, the term of this patent is extended or adjusted under 35 U.S.C. 154(b) by 33 days.

(21) Appl. No.: 10/134,870

(22) Filed: Apr. 29, 2002

(65) Prior Publication Data

US 2003/0204997 A1 Nov. 6, 2003

(51) Int. Cl.[7] ..... E06B 7/30
(52) U.S. Cl. ..... 49/171; 359/504
(58) Field of Search ..... 49/171; 109/58.5, 109/21.5; 359/503, 504, 511, 507

(56) References Cited

U.S. PATENT DOCUMENTS

| | | | | | |
|---|---|---|---|---|---|
| 2,000,206 | A | * | 5/1935 | Yozewitch | 4/295 |
| 2,016,862 | A | * | 10/1935 | Kniesner | 49/171 |
| 2,044,625 | A | * | 6/1936 | Murphy | 4/295 |
| 2,124,525 | A | * | 7/1938 | Frankel | 49/171 |
| 2,222,691 | A | * | 11/1940 | Taigman | 70/431 |
| 2,291,821 | A | * | 8/1942 | McNabb | 359/511 |
| 2,444,340 | A | * | 6/1948 | Donahue | 4/680 |
| 2,583,228 | A | * | 1/1952 | Numbers | 359/511 |
| 2,638,810 | A | * | 5/1953 | Berleme | 359/504 |
| 2,696,672 | A | * | 12/1954 | Durfee | 359/511 |
| 3,039,117 | A | * | 6/1962 | Hoskins | 4/444 |
| 3,094,712 | A | * | 6/1963 | Rath | 4/295 |
| 3,394,671 | A | * | 7/1968 | Mayer | 114/183 R |
| 3,494,504 | A | * | 2/1970 | Jackson | 220/237 |
| 3,599,821 | A | * | 8/1971 | Eggert et al. | 215/301 |
| 4,116,529 | A | | 9/1978 | Yamaguchi | 350/69 |
| 4,230,231 | A | * | 10/1980 | Burnett et al. | 215/329 |
| 4,269,474 | A | * | 5/1981 | Kamimura | 359/504 |
| 4,327,960 | A | * | 5/1982 | Gould | 359/511 |
| 4,348,083 | A | | 9/1982 | Kamimura | 350/453 |
| 4,763,444 | A | | 8/1988 | Ritchie | 49/171 |
| 4,817,450 | A | * | 4/1989 | Jachim | 73/866.5 |
| 4,892,399 | A | | 1/1990 | Ahn | 350/569 |
| 5,138,487 | A | | 8/1992 | Ahn | 359/431 |
| 5,150,528 | A | * | 9/1992 | Shire | 42/129 |
| D330,211 | S | | 10/1992 | Degnan | D16/130 |
| 5,161,328 | A | | 11/1992 | Traue | 49/171 |
| 5,221,992 | A | | 6/1993 | Park | 359/504 |
| 5,262,901 | A | | 11/1993 | Degnan | 359/819 |
| D365,833 | S | | 1/1996 | Werner | D16/135 |
| D372,104 | S | | 7/1996 | Scott | D25/48 |
| 6,073,335 | A | * | 6/2000 | Lampers | 29/525.01 |
| 6,450,367 | B1 | * | 9/2002 | Sittler | 222/39 |

OTHER PUBLICATIONS

Copy of Web Page of VingCard entitled "Door Viewers" dated 1998.
Copy of Web Page of VingCard dated 2000.
Copy of Web Page of Private Eye (undated).
Copy of Web Page of Nexus Enterprises, Inc. entitled "Optical Door Viewer". (undated).
Copy of Web Page of Michael Holigan's Your New House On Line dated 1998.

* cited by examiner

*Primary Examiner*—Gregory J. Strimbu
(74) *Attorney, Agent, or Firm*—Cahill, von Hellens & Glazer, P.L.C.

(57) ABSTRACT

A conventional commercial door viewer includes a lens at one end for providing a wide angle view and a hollow end through which a person would look. A truncated cone shaped plug fits within the hollow end to block light transmission through the door viewer. The plug is readily manually removable to use the door viewer and includes a removable lanyard to tether the plug in proximity to the door viewer.

7 Claims, 1 Drawing Sheet

DOOR VIEWER PLUG

BACKGROUND OF THE INVENTION

1. Field of the Invention

The present invention relates to security devices and, more particularly, to a plug for blocking transmission through a door viewer from a light source.

2. Description of Related Art

For security purposes, and, more particularly, to determine the identity of a person seeking to enter a building, door viewers of various types have been developed. These door viewers generally include a lens system for providing to a person on the inside a wide angle view to the outside. Thereby, the person on the inside has an opportunity to view and identify a person(s) seeking entry prior to permitting entry by opening the door. Generally, the commercially available door viewers for this purpose are adequate in providing the results sought.

The lens system in commercially available viewers does not permit a person outside to view with any clarity a person or features of the room inside the door. However, the door viewer does transmit light from the inside to the outside. If there is no light source optically aligned with the door viewer, ambient light is transmitted through the door viewer from the inside to the outside. In such event, the intensity of the light transmitted is essentially unaffected by a person on the inside looking through the viewer from a short distance removed therefrom. However, if a light source is optically aligned with the door viewer, any blockage of light from such light source to the door viewer will reduce the intensity of the light transmitted through the door viewer. Thus, a person on the outside can readily determine, by the change in light intensity emanating from the door viewer, that a person is present inside in proximity to the door viewer. While it is impossible for the inside person to be recognized due to the optics of the door viewer, the person on the outside will know that a person is inside the building. This information can be used by a thief or burglar as part of the decision making process of whether to burglarize or break into the building. There have also been reported instances of a thief or burglar injuring the person on the inside by driving an icepick or the like through the door viewer when the person on the inside was looking through it, as would be evident by the change in light intensity emanating from the door viewer.

There are available lenses which can be used in conjunction with a conventional commercial door viewer that permit a person from the outside to view with clarity the surroundings on the inside of the door. Thus, the privacy intended by a commercially available viewer is compromised. Such compromise and effect thereof is of particular concern in commercial establishments, such as motels and hotels which have door viewers and wherein the occupants are generally viewable as their activities are normally conducted within the room into which the door opens. Moreover, for a person with criminal intentions the opportunity to view and assess the nature of the occupants prior to committing a criminal act may be of significant benefit and to the detriment of the occupants.

Conventional commercially available door viewers permit transmission of light from the exterior to the interior space of a room into which the door opens. This light transmission will vary from intermittent, partial or complete blockage of light entering the door viewer as persons walk by on the outside. The resulting flickering seen on the inside of a door viewer may be particularly disturbing to a motel or a hotel guest who has turned out the lights and is trying to sleep.

SUMMARY OF THE INVENTION

The present invention is directed to a portable or permanently installed blockage for precluding light transmission through a door viewer from the inside to the outside. Furthermore, during daylight conditions, removal of the blockage for purposes for of using the viewer will not provide an indication of whether a viewer on the inside is looking through the door viewer.

It is therefore a primary object of the present invention to provide a portable blockage for precluding light transmission through a door viewer.

Another object of the present invention is to provide a demountable blockage for a door viewer which is attached to the door viewer.

Still another object of the present invention is to provide a selectively usable blockage attached to a door viewer for selectively blocking light transmission through the door viewer.

Yet another object of the present invention is to provide an inexpensive portable or permanently mounted plug for use with a door viewer.

A further object of the present invention is to provide a selectively removable plug for use with a conventional door viewer.

A still further object of the present invention is to provide a plug removable from the inside of a door viewer which does not signal use of the door viewer to a person on the outside.

A yet further object of the present invention is to provide a method for selectively controlling light transmission through a door viewer.

These and other objects of the present invention will become apparent to those skilled in the art as the description thereof proceeds.

BRIEF DESCRIPTION OF THE DRAWINGS

The present invention will be described with greater specificity and clarity with reference to the following drawings, in which.

DESCRIPTION OF THE PREFERRED EMBODIMENT

Figure 1:
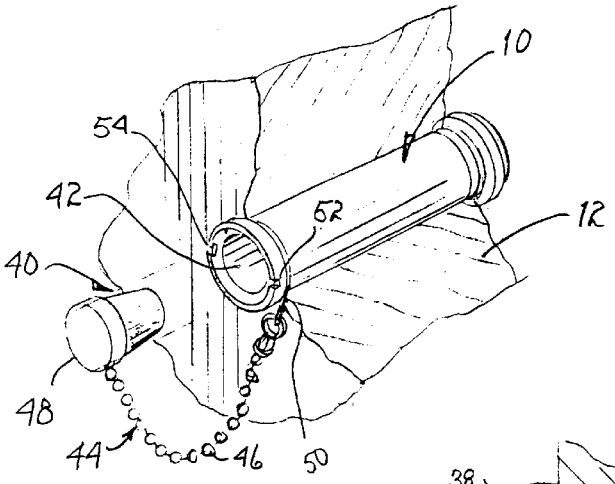
FIG. 1 illustrates the present invention attached to a conventional door viewer mounted in a door.
Figure 2:
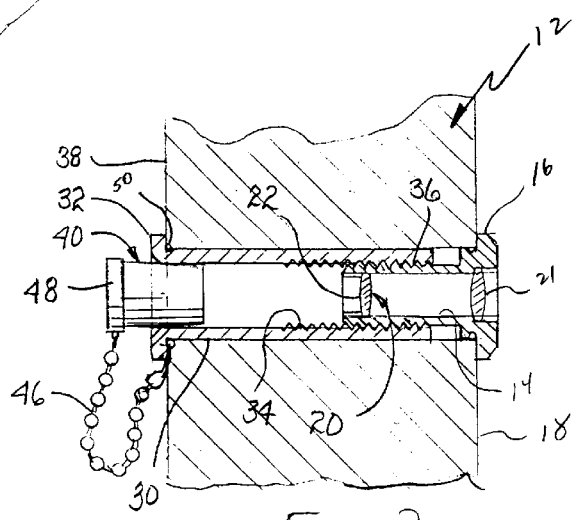
FIG. 2 is a partial cross-sectional view of the present invention mounted in a door viewer.

Referring jointly to FIGS. 1 and 2, there is shown a conventional door viewer 10 mounted within a door 12. Usually, the door is the front door of a dwelling or the door to a hotel or motel room. The door viewer has essentially three components. The first component is a cylinder 14 having an annular flange 16 for abutting engagement with outside surface 18 of door 12. The interior of cylinder 14 includes a lens system 20, representatively depicted by lenses 21 and 22. The lens system provides a wide angle view of the area outside of door 12 and essentially distorts the view through the door viewer from the outside into the space behind the door. A sleeve 30 including an annular flange 32 is essentially hollow. The interior of sleeve 30 includes threads 34 for threaded engagement with threads 36 on the exterior of cylinder 14. With such threaded engagement between the cylinder and the sleeve, a range of widths of door 12 can be accommodated.

A plug 40, which may be in the shape of a truncated cone, as illustrated, is demountably mounted within hollow end 42 of door viewer 10. Following such mounting, transmission of light through the door viewer from a location outside of door 12 is precluded. As particularly shown in FIGS. 1 and 3, plug 40 is readily mounted in or demounted from engagement with the door viewer.

To insure accessibility of plug 40 and to minimize the likelihood of loss or misplacement, the plug may be attached to the door viewer through a lanyard 44 or the like. As shown, the lanyard may be a chain 46 of metallic material or of manmade material. The lanyard may be attached to a cap 48, which cap receives and retains one end of plug 40.

The other end of lanyard 44 may be attached to door viewer 10 by use of attachment means, such as a cord or a wire 50, secured to and extending from the lanyard. As discussed above, sleeve 30 is in threaded engagement with cylinder 14. To assist in threading and unthreading the sleeve, a pair of diametrically opposed slots 52, 54 may be formed in annular flange 32. These slots can be engaged by a coin or the like to provide a grip for rotating the sleeve. Upon rotation of the sleeve in one direction, such as counterclockwise, the sleeve will be urged to translate away from the door and provide a space between annular flange 32 and interior surface 38 of the door. By wrapping a section of the attachment means, such as wire 50, about the sleeve adjacent annular flange 32, and thereafter rotating the sleeve in a clockwise direction, wire 50 will become captured between annular flange 32 and surface 38 of the door. Thereby, plug 40 and its attached lanyard 44 will remain in proximity with door viewer 10 when the plug is not engaged with the door viewer and loss or misplacement is essentially eliminated. Because of this simple mode of attaching plug 40, it can be temporarily attached at temporary abodes of the user, such as hotel room and motel room doors. To disengage plug 40 and its attached lanyard 44, the above described process can be reversed to release wire 50 from between annular flange 32 and surface 38 of door 12.

One of the optical characteristics of a conventional door viewer of the type illustrated in FIGS. 1 and 2 is that blockage of a source of light transmitting light directly through the door viewer can be detected by a person outside of the door. However, when ambient light interior of the door is the only light transmitted through the door viewer, no or little change in intensity of the light transmitted is detectable if a person were to place one's head in position to look through the door viewer from the inside to the outside.

Figure 3:
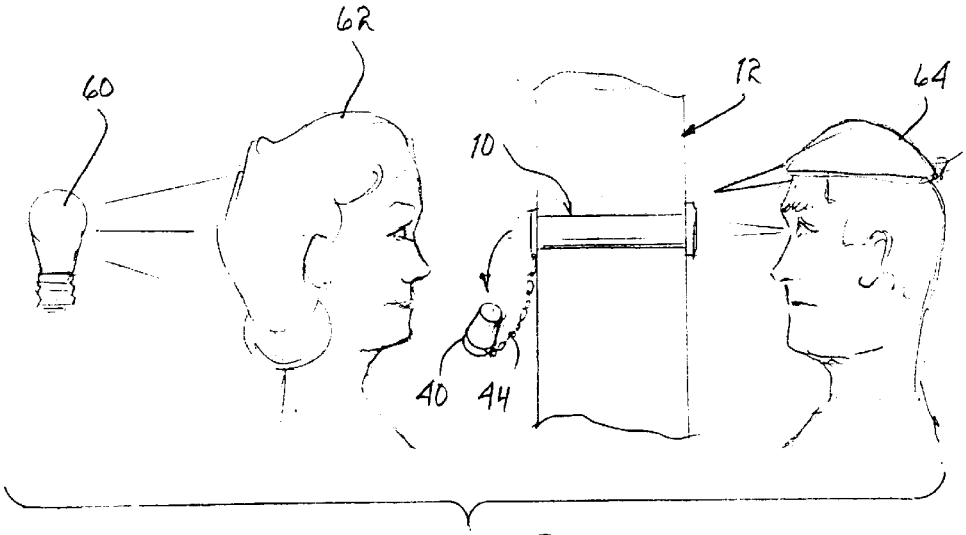
FIG. 3 illustrates use of the present invention while precluding an indication to a person on the outside that the door viewer is being used by a person on the inside.

As shown in FIG. 3, it is assumed that a source 60 of light would transmit light directly through door viewer mounted within door 12. In such event, if a person 62 were to look through the door viewer, the transmission of light from source 60 would be blocked. The resulting change in intensity of light detectable by a person 64 outside of door 12 would provide an indication of the presence of person 62.

The present invention is particularly suited to avoid such indication of the presence of a person 62. When a person 62 decides to look through door viewer 10, the person would block direct light transmission from source 60 through the door viewer and only ambient light would be available for transmission through the door viewer. When in such position, person 62 would remove plug 40 from the door viewer. The resulting light transmitted through the door viewer would not change as a function of movement of person 62 unless such person's movements would result in transmission of light directly from source 60. That is, only ambient light would be transmitted through the door viewer and the intensity of such ambient light would remain essentially constant despite some movement of person 62. Thus, a person 64 on the outside of door 12 would not be aware of whether person 62 was or was not looking through the door viewer and hence the presence of person 62 would be unknown.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

I claim:

1. In door viewer for mounting in a door, which door viewer includes a hollow sleeve having an annular flange for bearing against the door, the improvement comprising a security device for regulating light transmission through said viewer, said security device comprising in combination:

a) a tapered plug defining a solid truncated cone and having first and second ends, said first end having a diameter greater than a diameter of said second end, said second end and a part of said plug being demountably mountable within the sleeve of the door viewer for regulating the light transmission through the door viewer;

b) a cap receiving only said first end and a part of said plug extending from said first end;

c) a lanyard extending from said cap and retaining said plug attached to the door viewer; and d) attachment means for positioning between the annular flange of the sleeve and the door for securing said lanyard to the door.

2. A combination as set forth in claim 1 wherein said lanyard is a chain.

3. A combination as set forth in claim 1 wherein said attachment means comprises a wire.

4. A combination as set forth in claim 3 wherein said lanyard is a chain.

5. In door viewer, which door viewer includes a cylinder supporting a lens system and a sleeve having a hollow end terminated by a radially extending annular flange and threadedly attached to the cylinder to mount the door viewer in a door, the improvement comprising a security device for controlling light transmission through said viewer, said security device comprising in combination:

a) a tapered solid cone shaped plug having a first and a second end, said first end having a greater surface area than said second end, said second end of said plug being adapted for partial insertion into and engagement with the hollow end of the sleeve;

b) a cap receiving and retaining said first end and only a part of said plug adjacent said first end;

c) a flexible lanyard extending from said cap; and d) a section of said lanyard being disposed around said sleeve and adapted to be captured between the annular flange of the sleeve and the door.

6. A combination as set forth in claim 5 wherein said lanyard is a chain.

7. A combination as set forth in claim 5 wherein said section is a wire.

* * * * *